US005483861A

United States Patent [19]

Kawamura et al.

[11] Patent Number: 5,483,861

[45] Date of Patent: Jan. 16, 1996

[54] KEYBOARD INSTRUMENT EQUIPPED WITH DURABLE HAMMER STOPPER FOR SELECTIVELY PRODUCING ACOUSTIC SOUNDS AND SYNTHESIZED SOUNDS

[75] Inventors: Kiyoshi Kawamura; Motoya Kondo, both of Hamamatsu, Japan

[73] Assignee: Yamaha Corporation, Japan

[21] Appl. No.: 262,230

[22] Filed: Jun. 20, 1994

[51] Int. Cl.[6] ..... G10C 3/12; G10C 5/00; G10D 15/00; G10H 1/34

[52] U.S. Cl. ..... 84/719; 84/720; 84/171; 84/423 R; 84/DIG. 7

[58] Field of Search ..... 84/719, 720, 2, 84/3, 171, 236–255, 423 R, 433, DIG. 7

[56] References Cited

U.S. PATENT DOCUMENTS

| | | | |
|---|---|---|---|
| 533,661 | 2/1894 | McChesney et al. . | |
| 537,533 | 10/1894 | McChesney et al. . | |
| 2,250,065 | 7/1974 | Koel | 84/171 |
| 4,633,753 | 1/1987 | Takahashi | 84/220 |
| 4,704,931 | 1/1987 | Nagai | 84/1.01 |
| 4,744,281 | 3/1987 | Isozaki | 84/1.28 |
| 4,970,929 | 11/1990 | Ishida | 84/120 |
| 5,001,339 | 3/1991 | Starkey et al. | 250/229 |
| 5,115,705 | 5/1992 | Monte et al. | 84/617 |
| 5,247,129 | 9/1993 | Nozaki et al. | 84/615 |

FOREIGN PATENT DOCUMENTS

| | | |
|---|---|---|
| 0270966A2 | 6/1988 | European Pat. Off. . |
| 0573963A2 | 12/1993 | European Pat. Off. . |
| 97885 | 10/1897 | Germany . |
| 44782 | 9/1898 | Germany . |
| 3707591C1 | 5/1988 | Germany . |
| TO91U000077 | 10/1992 | Ireland . |
| 51-67732 | 5/1976 | Japan . |
| 55-55880 | 4/1980 | Japan . |
| 62-32308 | 8/1987 | Japan . |
| 63-97997 | 4/1988 | Japan . |

*Primary Examiner*—Stanley J. Witkowski
*Attorney, Agent, or Firm*—Graham & James

[57] ABSTRACT

In order to allow a player to perform a music without an acoustic sound, a stopper blocks hammer shanks before impacts of hammer heads to strings, and recesses substantially conformal to the hammer shanks are formed in cushion members of the stopper for improving durability of the cushion members.

9 Claims, 12 Drawing Sheets

KEYBOARD INSTRUMENT EQUIPPED WITH DURABLE HAMMER STOPPER FOR SELECTIVELY PRODUCING ACOUSTIC SOUNDS AND SYNTHESIZED SOUNDS

FIELD OF THE INVENTION

This invention relates to a keyboard instrument and, more particularly, to a piano-like keyboard instrument for selectively producing acoustic sounds and synthesized sounds.

DESCRIPTION OF THE RELATED ART

Typical examples of the keyboard instrument are disclosed in Japanese Patent Applications No. 4-174813 filed on Jun. 9, 1992, No. 4-207352 filed on Jul. 10, 1992, No. 4-299234 filed on Oct. 12, 1992 and No. 5-31420 filed on Jan. 27, 1993, and U.S. Ser. No. 08/073,092 and European Patent Application No. 93 109 211.8 were filed on the basis of these Japanese Patent Applications.

An acoustic piano and an electronic sound producing system form in combination each of the prior art keyboard instruments. While a player is performing a music on the keyboard in an acoustic sound mode, the keyboard instrument produces acoustic sounds through vibrations of the strings. However, if the player instructs the keyboard instrument to enter the silent mode, a shank stopper is moved to the blocking position where the hammer shanks are brought into contact with the shank stopper before rebound on the strings. As a result, the strings do not vibrate, and synthesized sounds are produced by the electronic sound producing system instead of the acoustic sounds.

Various shank stoppers are proposed in the Japanese Patent Applications. Even though the contact surfaces of the shank stoppers are either flat or curved, the cross section of the cushion members incorporated in the respective shank stoppers are unchanged along the lateral direction of the keyboard, and the contact surface straightly extends along the array of the hammer shanks. For this reason, the hammer shank is initially brought into contact with a relatively narrow area of the contact surface, and is decelerated by deforming the cushion member.

If a shank stopper 1 opposes a curved contact surface 1*a* to a hammer shank 2 as shown in FIG. 1, the hammer shank 2 is initially brought into contact with a narrow area 1*b* of the curved contact surface 1*a*. On the other hand, if another shank stopper 3 opposes a flat contact surface 3*a* to the hammer shank 2, the hammer shank 2 is initially brought into contact with an elongated narrow area 3*b* as shown in FIG. 2.

In either shank stopper 1 or 3, the hammer shank 2 impacts at the narrow area 1*b* or 3*b*, and the kinetic energy of the hammer assembly is converted into an impact on the narrow area 1*b* or 3*b*. Thus, the impact concentrated on the narrow area 1*b* or 3*b* repeatedly damages the cushion member 1 or 3, and the cushion member 1 or 3 is finally torn by the hammer shank.

SUMMARY OF THE INVENTION

It is therefore an important object of the present invention to provide a keyboard instrument which has a shank stopper less damaged by hammer shanks.

To accomplish the object, the present invention proposes to form recesses in a stopper for receiving hammer shanks.

In accordance with the present invention, there is provided a keyboard instrument selectively entering into an acoustic sound mode for producing acoustic sounds and a silent mode for producing synthesized sounds, comprising: a) an acoustic piano having a-1) a keyboard having a plurality of swingable keys selectively depressed by a player in both acoustic sound and silent modes, a-2) a plurality of key action mechanisms respectively linked with the plurality of swingable keys, and actuated by the depressed keys in both acoustic sound and silent modes, a-3) a plurality of hammer assemblies having respective contact portions, and selectively driven by the key action mechanisms linked with the depressed keys for rotations in both acoustic sound and silent modes, a-4) a plurality sets of strings respectively associated with the plurality of hammer assemblies, and selectively struck by the hammer assemblies associated with the key action mechanism linked with the depressed keys in the acoustic sound mode for producing the acoustic sounds; b) a controlling system having a stopper, and responsive to an instruction of the player for changing the stopper between a free position in the acoustic sound mode and a blocking position in the silent mode, the hammer assemblies rebounding on the associated sets of strings when the stopper is in the free position, the hammer assemblies rebounding on the stopper before the impacts of the hammer assemblies on the associated sets of strings when the stopper is changed to the blocking position, the stopper having a plurality of recesses for receiving the contact portions of the associated hammer assemblies, an inner surface of each of the recesses being substantially conformal to a part of the outer surface of the contact portion of the associated hammer assembly; and c) an electronic sound generating system enabled in the silent mode, and producing the synthesized sounds with notes assigned to the depressed keys.

The recesses may be formed by pressing the contact portions against the hammer assemblies.

BRIEF DESCRIPTION OF THE DRAWINGS

The features and advantages of the keyboard instrument according to the present invention will be more clearly understood from the following description taken in conjunction with the accompanying drawings in which.

DESCRIPTION OF THE PREFERRED EMBODIMENTS

First Embodiment

Figure 1:
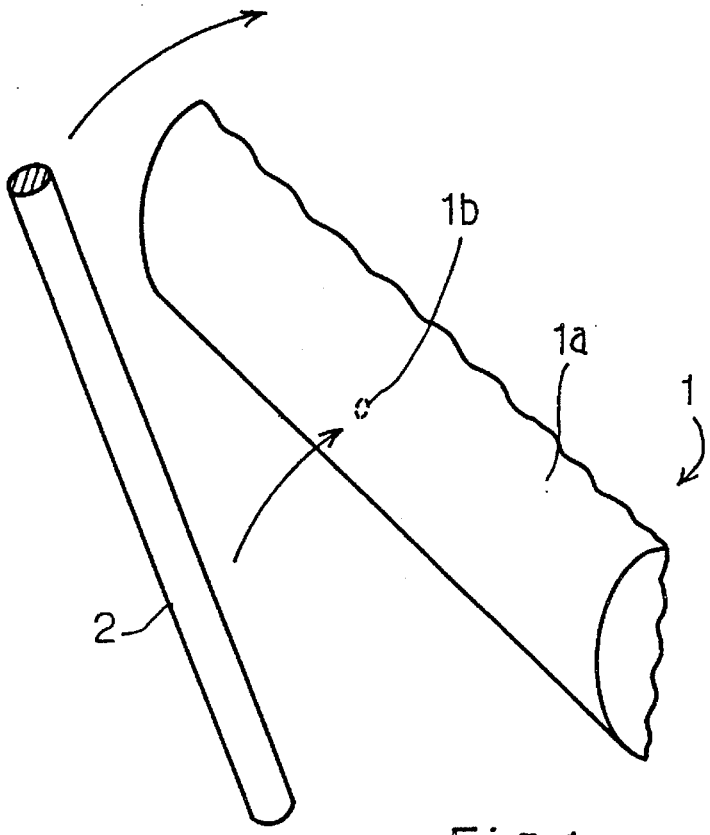
Fig. 1 PRIOR ART
FIG. 1 is a perspective view showing the prior art shank stopper and the associated hammer shank.
Figure 2:
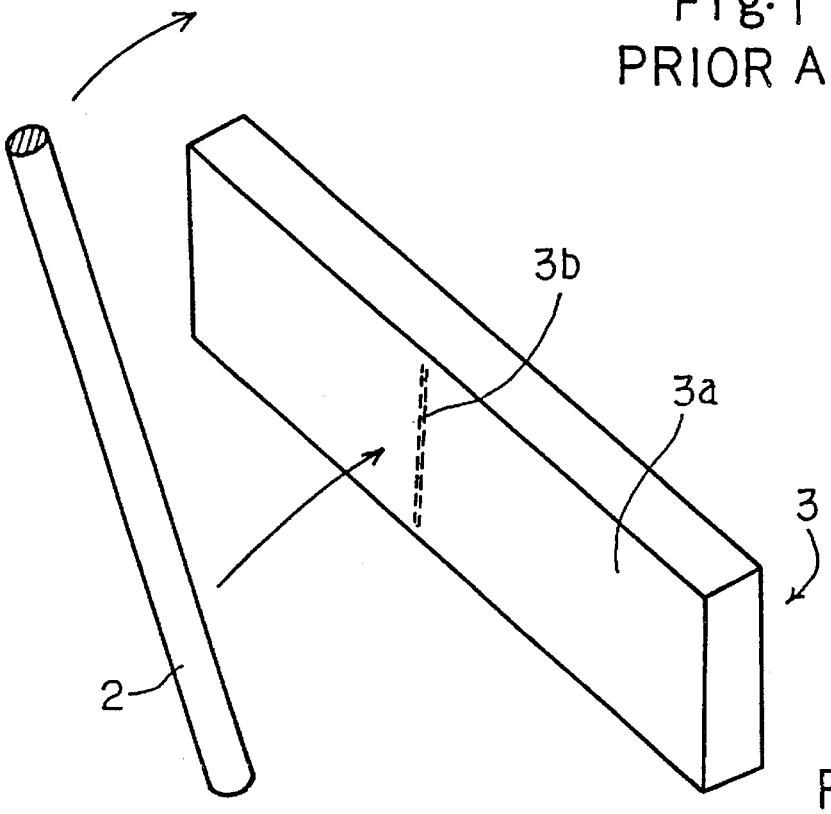
Fig. 2 PRIOR ART
FIG. 2 is a perspective view showing another prior art shank stopper and the associated hammer shank.
Figure 3:
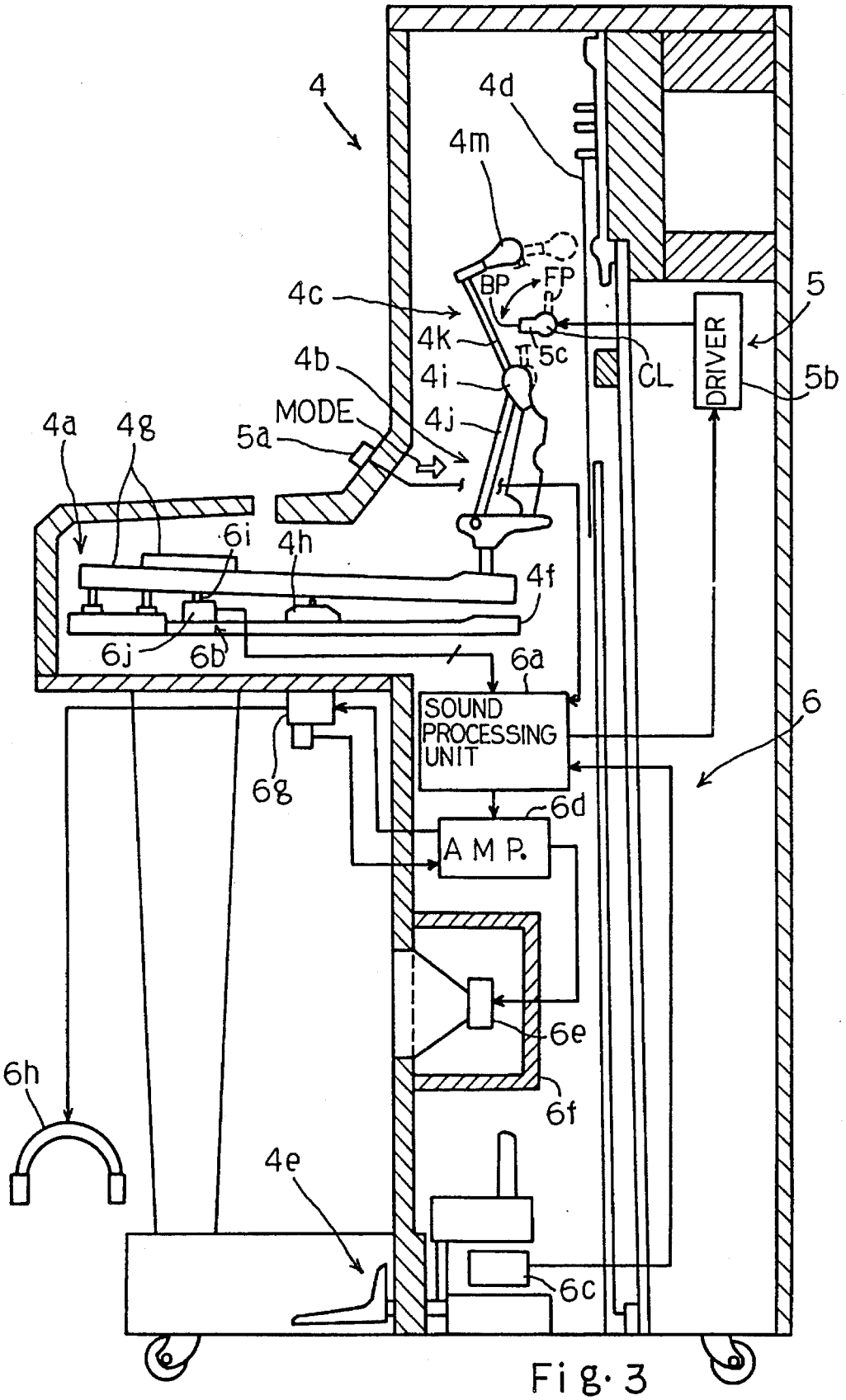
FIG. 3 is a cross sectional view showing the structure of a keyboard instrument according to the present invention.

Referring to FIG. 3 of the drawings, a keyboard instrument embodying the present invention largely comprises an acoustic piano 4, a controlling system 5 and an electronic sound generating system 6, and selectively enters an acoustic sound mode and a silent mode. While the keyboard instrument is staying in the acoustic sound mode, the keyboard instrument serves as an acoustic upright piano, and not only the sounds but also the key-touch are identical with those of the acoustic upright piano.

On the other hand, when the keyboard instrument is changed to the silent mode, the keyboard instrument electronically synthesizes sounds in response to the fingering, or keeps silent. In this instance, the acoustic piano 4 is of the upright type. However, the acoustic piano 4 may be of a grand type.

The acoustic piano 4 comprises a keyboard 4*a*, a plurality of key action mechanisms 4*b*, a plurality of hammer mechanisms 4*c*, a plurality sets of strings 4*d* and a pedal mechanism 4*e*. The keyboard 4*a* is mounted on a key bed 4*f*, and is fabricated from black and white keys 4*g*. The black and white keys 4*g* are turnable with respect to balance pins embedded in a balance rail 4*h*.

The key action mechanisms 4*b* are respectively linked with the rear ends of the black and white keys 4*g*, and drive the hammer mechanisms 4*c*. Each key action mechanism 4*b* is similar to a key action mechanism for an upright piano, and no further description is incorporated hereinbelow for the sake of simplicity.

Each of the hammer mechanisms 4*c* comprises a butt 4*i* kicked by the jack 4*j* of the associated key action mechanism 4*b*, a hammer shank 4*k* implanted into the butt 4*j* and a hammer head 4*m* coupled with the leading end of the hammer shank 4*k*. When the jack 4*j* kicks the butt 4*i*, the butt 4*i* and, accordingly, the hammer shank 4*i* are driven for rotation toward the associated strings 4*d*, and the hammer head 4*m* strikes the strings 4*d* so that the strings 4*d* vibrate for producing an acoustic sound.

When the keys 4*g* are in the rest position where a player does not depress the keys, the hammer assemblies 4*c* are staying at home positions thereof.

The pedal mechanism 4*e* usually have three pedals and three pedal link sub-mechanisms respectively associated with the three pedals. One of the three pedals is called as a damper pedal, and allows the strings to prolong the sound. The second pedal is called as a soft pedal, and causes the hammer heads to softly strike the associated strings for lessening the volume. The last pedal is called as a sostenuto pedal, and enables selected notes to be sustained independently from the others.

The controlling system 5 comprises a sound processing unit 6*a* partially shared with the sound generating system 6, a mode shift switch 5*a*, a motor driver unit 5*b* and a rotary stopper 5*c*. The mode shift switch 5*a* is manipulated by a player, and produces an instruction signal MODE indicative of either acoustic sound or silent mode. The sound processing unit 6*a* periodically checks an input port assigned to the instruction signal MODE to see whether or not the player changes the operation mode. While the keyboard instrument is staying in the acoustic sound mode, the sound processing unit 6*a* instructs the motor driver unit 5*b* to keep the rotary stopper 5*c* in a free position FP where the hammer heads 4*m* rebound on the associated strings 1*d* without interruption of the rotary stopper 5*c*.

On the other hand, if the instruction signal MODE is indicative of the silent mode, the sound processing unit 6*a* instructs the motor driver 5*b* to change the rotary stopper 5*c* from the free position FP to a blocking position BP, and the rotary stopper 5*c* blocks the hammer assemblies 4*c* before the impacts of the hammer heads 4*m* on the strings 4*d*. For this reason, the strings 4*d* do not vibrate in the silent mode, and the acoustic sounds are never produced.

The rotary stopper 5*c* is located in the vicinity of the strings 4*d*, and is closer to the butts 4*i* rather than the hammer heads 4*m*. The location of the rotary stopper 5*c* is desirable, because the hammer shanks 4*k* are resiliently deformed as if the hammer heads 4*m* rebound on the associated strings 4*d*.

When the stopper 5*c* is moved to the blocking position BP, the rotational axis CL of the rotary stopper 4*k* is substantially perpendicular to a line of action of each hammer shank 4*k* at the impact, and a moment is not exerted on the rotary stopper 5*c*. For this reason, a designer makes the rotary stopper 5*c* compact, and the rotary stopper 5*c* can be provided in a narrow space between the hammer assemblies 4*c* and the strings 4*d*.

Figure 4:
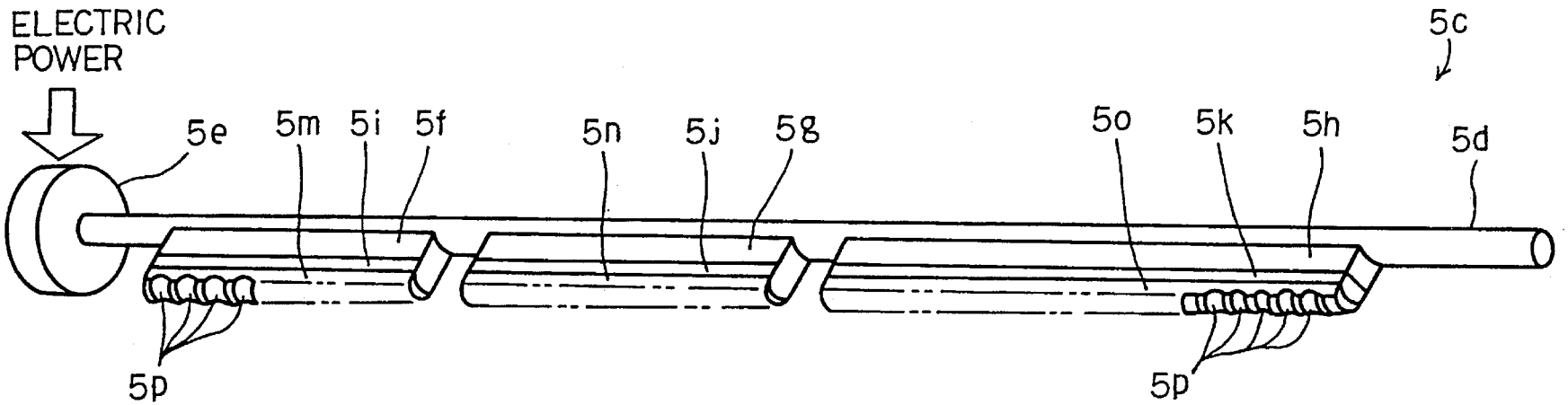
FIG. 4 is a perspective view showing a rotary stopper incorporated in the keyboard instrument shown in FIG. 3.

Turning to FIG. 4 of the drawings, the rotary stopper 5*c* is illustrated in an enlarged scale, and comprises a shaft member 5*d* of either steel, aluminum or plastic, a motor unit 5*e*, three bracket members 5*f*, 5*g* and 5*h*, three relatively hard cushion members 5*i*, 5*j* and 5*k* and three relatively soft cushion sheets 5*m*, 5*n* and 5*o*. Each of the relatively soft cushion member 5*m*/5*n*/5*o* and each of the relatively hard cushion member 5*i*/5*j*/5*k* form a laminated structure or a cushion member. The shaft member 5*d* extends in a lateral direction of the keyboard instrument along the array of the hammer assemblies 4*c*, and has a center axis substantially aligned with a drive shaft (not shown) of the motor unit 5*e*.

The motor unit 5*e* is bidirectionally rotatable, and the drive shaft is coupled with the shaft member 5*d*. The motor unit 5*e* is a stepping motor, and is energized for driving the shaft member 5*d* in one of the clockwise direction and the counter clockwise direction. In another implementation, the motor unit 5*e* may be an ultrasonic motor. The ultrasonic motor can maintain the shaft at any position without current, and quietly rotates at a low speed without any backlash. These features are desirable for a musical instrument.

Though not shown in the drawings, the shaft member 5*d* is rotatably supported by action brackets (not shown) and section plates (not shown), and the action brackets and the section plates are connected at upper end portions thereof with a pin block (not shown) by means of action bolts (not shown) and at the lower end portions thereof with the key bed 4*f* through bracket blocks (not shown).

The three bracket members 5*f* to 5*h* are attached to the shaft member 5*d* at intervals, and the three relatively hard cushion members 5*i* to 5*k* are attached to the three bracket members 5*f* to 5*h*, respectively. The relatively hard cushion members 5*i* to 5*k* are formed of felt or urethane.

The relatively soft cushion sheets 5m to 5o are similarly formed of felt or urethane, and are bonded to the relatively hard cushion members 5i to 5h. The relatively soft cushion members 5i to 5h effectively takes up the impact of the hammer shank 4j without noise, and the relatively hard cushion members 5m to 5o effectively prevent the strings 4d from the impact of the hammer shank 4k in the silent mode. Thus, the laminated structure of hard and soft cushion members 5f/5g/5h and 5i/5j/5k is desirable for the stopper 5c.

Though not shown in FIG. 4, cushion sheets are further bonded to the shaft member 5d. When a damper head (not shown) is left from the strings, damper wires (not shown) are brought into contact with one of the cushion sheets, and a noise is not produced at the impact.

A plurality of recesses 5p are formed in the relatively soft cushion members 5m to 5o, and are conformal to the contact areas of the respective hammer shanks 4k. For this reason, each hammer shank 4k rebounds on the inner surface of the associated recess, and the impact of the hammer assembly 4c is taken up on a relatively wide area rather than the prior art shank stoppers. For this reason, the cushion member is durable against the impacts of the hammer shanks 4k, and the keyboard instrument according to the present invention serves prolonged time period without a maintenance.

Figure 5:
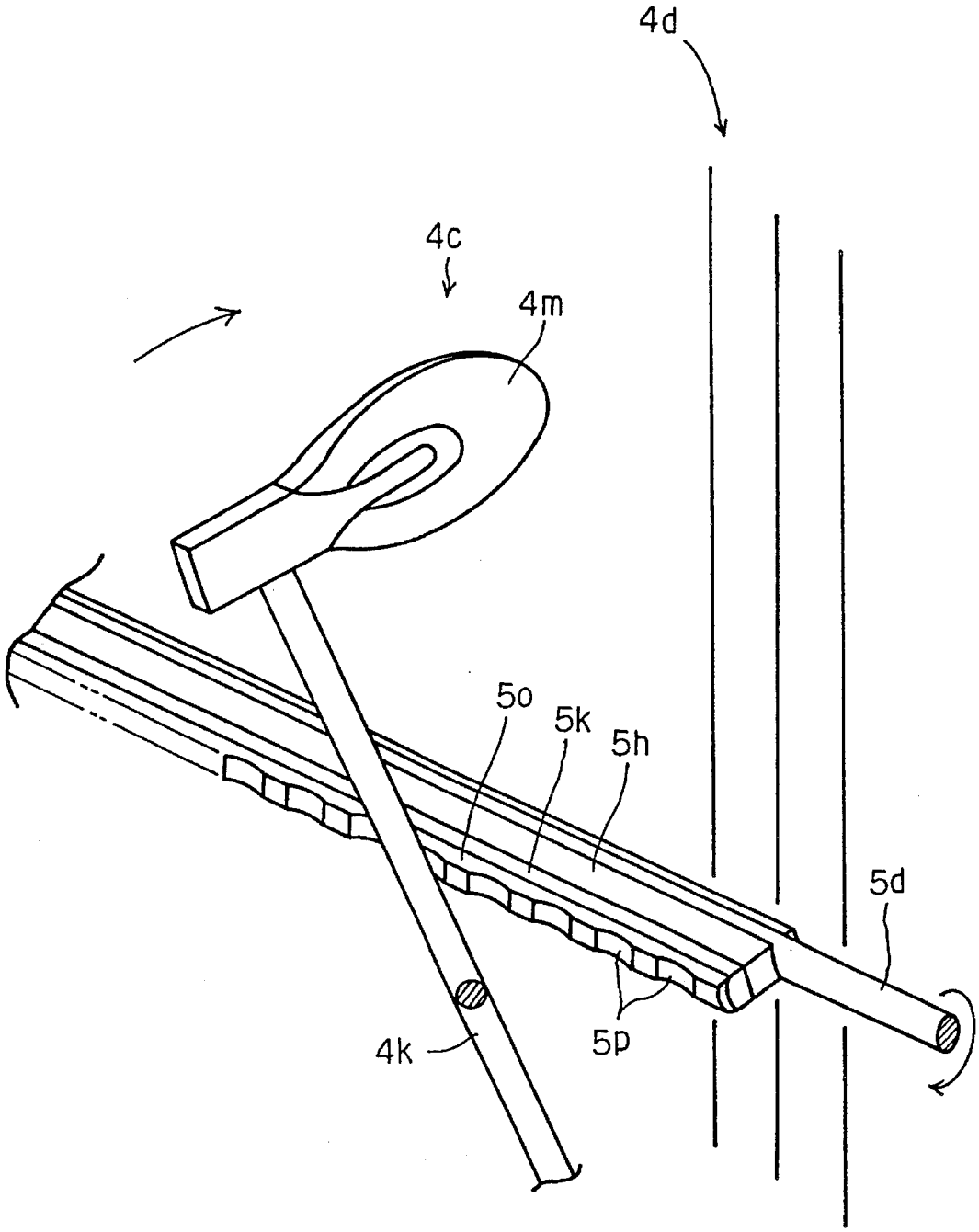
FIG. 5 is a perspective view showing a modification of the rotary stopper.

The formation of recesses 5p is usually carried out before assembly in a piano factory, and the hammer shanks 4k per se or suitable dies are pressed against the relatively soft cushion members 5m to 5p for plastic deformation. The surfaces of the relatively soft cushion members 5m to 5o may be partially cut for forming the recesses 5p as shown in FIG. 5.

Assuming now that a player starts a performance in the silent mode where the rotary stopper 5c is staying in the blocking position BP, the three relatively soft cushion members 5m to 5o are directed to the hammer shanks 4k as indicated by the real line in FIG. 3. The key action mechanisms 4b sequentially drive the associated hammer assemblies for rotation, and the key action mechanisms 4b and the hammer assemblies give the piano key touch to the player through the escape of the jacks 4j from the associated butts 4i. The hammer assemblies 4c travel over the distance from the home positions thereof to the rotary stopper 5c, and the hammer shanks 4k softly impact on the inner surfaces of the recesses 5p of the associated relatively soft cushion members 5m to 5o or on leather sheets (not shown) bonded to the cushion members 5m to 5o. The hammer assemblies 4c rebounds on the inner surfaces of the recesses 5p before striking the associated strings 4d, and the strings 4d are prevented from vibrations for producing the acoustic sounds.

On the other hand, while the player is performing a music in the acoustic sound mode, the rotary stopper is kept in the free position FP as indicated by broken lines in FIG. 3, and the gap between the hammer shanks 4k and the relatively soft cushion members 5m to 5o is wide enough to allow the hammer shanks 4j to strike the associated strings 4d. The key action mechanisms 4b and the hammer assemblies 4c behave as similar to those of an ordinary upright piano, and the strings 4d vibrate for producing the acoustic sounds.

The electronic sound generating system 6 comprises the sound processing unit 6a partially shared with the controlling system 5, a plurality of key sensors 6b, a pedal sensor 6c associated with the damper pedal, an amplifier unit 6d, a speaker system 6e housed in a speaker box 6f, a socket unit 6g and a headphone 6h detachable from the socket unit 6g, and is activated in the silent mode. In this instance, the keyboard instrument is equipped with both of the speaker system 6e and the headphone 6g. However, only the headphone may be incorporated in the electronic sound generating system 6.

The key sensors 6b are respectively associated with the plurality-of keys 4g, and each of the key sensors 6b comprises a shutter plate 6i fixed to the bottom surface of the associated key and a photo-interrupter 6j for monitoring the shutter plate 6i. Four different slit patterns are formed in the shutter plate 6i, and the four slit patterns sequentially pass through an optical path produced by the photo interrupter 6j when the associated key is depressed. The photo interrupter 6j produces a digital signal variable when the four slit patterns pass the optical path, and supplies the digital signal to the sound processing unit 6a. The sound processing unit 6a determines the key velocity and estimates the time when the associated hammer head 4m strikes the strings 4d.

The pedal sensor 6c monitor the damper pedal to see whether or not the player steps on it. If the player steps on the damper pedal, the pedal sensor 6c detects the current position of the damper pedal, and report the current position to the sound processing unit 6a.

Figure 6:
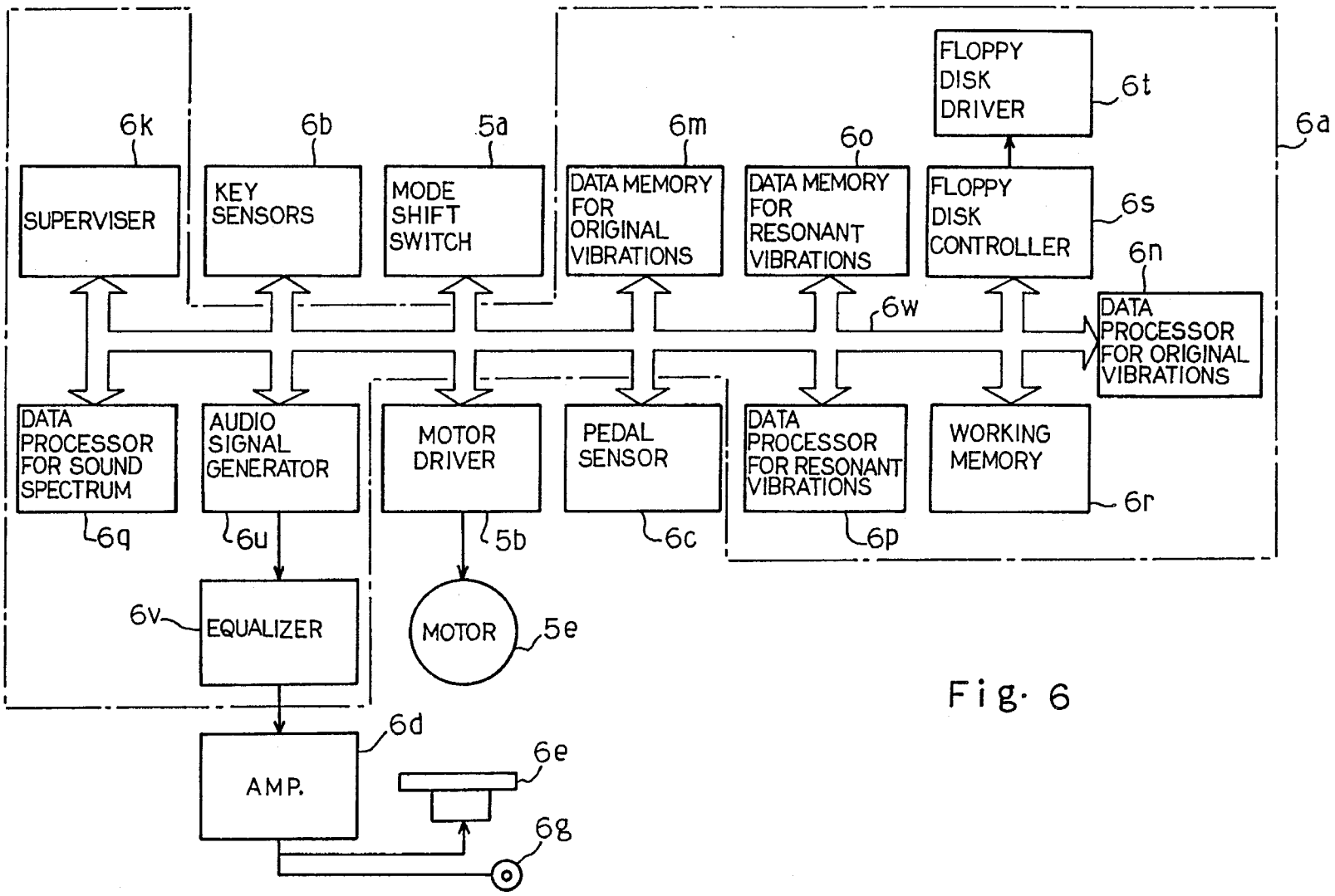
FIG. 6 is a block diagram showing the arrangement of a sound processing unit incorporated in the keyboard instrument shown in FIG. 3.

The sound processing unit 6a is arranged as shown in FIG. 6 of the drawings, and comprises a supervisor 6k, a data memory 6m for original vibrations, a data processor 6n for original vibrations, a data memory 6o for resonant vibrations, a data processor 6p for resonant vibrations, a data processor 6q for sound spectrum, a working memory 6r, a floppy disk controller 6s, a floppy disk driver 6t, an audio signal generator 6u, an equalizer 6v and a bus system 6w. In this instance, the data memories 6m and 6o are implemented by non-volatile memory devices such as, for example, read only memory devices, and random access memory devices serve as the working memory 6r.

The supervisor 6k sequentially scans signal input ports assigned to the instruction signal MODE, the digital signals from the key sensors 6b and the detecting signal from the pedal sensor 6c, and supervises the other components 6m to 6u for producing an audio signal. An internal table is incorporated in the supervisor 6k, and the internal table defines relation between the key numbers, key velocity and timings for producing the audio signal. The audio signal is supplied from the equalizer 6v to the amplifier unit 6d, and the audio signal is distributed to the speaker system 6e and the socket unit 6g for producing synthesized sounds. Various internal registers are incorporated in the supervisor 6k, and one of the internal registers is assigned to a mode flag indicative of the mode operation selected by the player.

The data memory 6m for original vibrations stores a plurality sets of pcm (Pulse Code Modulation) data codes indicative of frequency specular of original vibrations on the strings 4d, and each set of pcm data codes is corresponding to one of the keys 4g. A plurality groups of pcm data codes form a set of pcm data codes, and are corresponding to frequency specular at different intensities or hammer speeds. In general, if a hammer 4m strongly strikes the associated string 4d, higher harmonics are emphasized. The plurality sets of pcm data codes are produced with a sampler (not shown) through sampling actual vibrations on the respective strings 4d at an appropriate frequency. However, the set of pcm data codes may be produced by means of the data processor 6q through a real-time manner. Using a group of pcm data codes, original vibrations produced upon depressing a key 4g are restored, and the supervisor 6k controls the sequential access to a group of pcm data codes stored in the data memory 6m.

The data processor 6n for original vibrations is provided in association with the data memory 6m, and modifies a group of pcm data codes for an intermediate hammer speed. The modification with the data processor 6n is also controlled by the supervisor 6k.

The data memory 6o for resonant vibrations stores a plurality sets of pcm data codes indicative of resonant vibrations, and the resonant vibrations take place under stepping on the damper pedal.

While a player steps on the damper pedal of an upright piano, dampers are held off, and some of the strings 4d are resonant with the string struck by a hammer. The resonant tones range −10 dB and −20 dB with respect to the tone originally produced through striking with the hammer, and time delay of several millisecond to hundreds millisecond is introduced between the originally produced sound and the resonant tones. If the player continuously steps on the damper pedal, the resonant tones continues several seconds. However, the player can rapidly terminate the original and resonant tones by releasing the damper pedal.

The electronic sound generating system 6 can impart the same effect to the synthesized sounds, and the pcm data codes stored in the memory 6o are used for synthesizing the resonant tones. Namely, the audio signal generator 6u is responsive to the detecting signal of the pedal sensor 6c, and the supervisor 6k allows the pcm data codes to be sequentially fetched. The pcm data codes stored in the data memory 3o are indicative of frequency specular of the resonant vibrations, and are also produced by means of the sampler or the data processor 6p for resonant vibrations. Each set of pcm data codes is corresponding to one of the depressed keys 4g, and is constituted by six groups of pcm data codes at the maximum. Each group of pcm data codes is corresponding to one of the resonant strings 4d, and the second harmonic to the sixth harmonic are taken into account for strings one octave higher than low-pitched sounds. However, if the depressed key is lower than the thirteenth key from the lowest key in the eighty-eight keys, the string one octave lower than the depressed key should be taken into account. In general, seventy-one dampers are incorporated in a piano. However, another piano may have sixty-six dampers or sixty-nine dampers. As described hereinbefore, the intensity of frequency spectrum is corresponding to the hammer speed, and the intensities are variable with the type and model of the piano.

A set of pcm data codes are sequentially read out from the data memory 6o depending upon the depressed key 4g under the control of the supervisor 6k, and the data processor 6p for resonant vibrations modifies the pcm data codes for an intermediate intensity. The memory capacity of the data memory 6o may be large enough to store the pcm data codes at all of the detectable hammer speeds, and the data processor 6p may calculate each set of pcm data codes on the basis of parameters stored in the data memory 6o.

The data processor 6q for sound spectrum can produce the group of pcm data codes indicative of frequency spectrum for original vibrations and the set of pcm data codes indicative of frequency specular for resonant vibrations as described hereinbefore. The data processor 6q is further operative to cause the frequency specular to decay.

In detail, when a player releases a key of a piano, original vibrations on a string rapidly decays, because an associated damper returns to contact with the vibrating string. The data processor 6q simulates the decay, and sequentially decreases the values of the pcm data codes. The resonant tones continue for several seconds in so far as the player keeps the damper pedal in the depressed state. However, if the player releases the damper pedal, the resonant tones are rapidly decayed. The data processor 6q further simulates these decay, and sequentially decreases the values of the pcm data codes for the resonant vibrations.

The decay is not constant. If the player releases the damper pedal through a half pedal, the tones decay at lower speed rather than the ordinary release. Moreover, some players use the half pedal in such a manner as to retard low-pitched tones rather than high-pitched tones, and such a pedal manipulation is called as an oblique contact. On the contrary, if the damper pedal causes all the dampers to be simultaneously brought into contact with the strings, the damper manipulation is referred to as simultaneous contact. The data processor 6q can simulate the gentle decay upon the release through the half pedal as well as the oblique contact, and the values of the pcm data codes are decreased at either high, standard or low speed in the simultaneous contact and at different speed in the oblique contact. The data processor 6q may change the ratio between the fundamental tone and the harmonics thereof for the half pedal and decay high-order harmonics faster than the fundamental tone. The frame of a piano usually vibrates, and the frame noises participate the piano sound. The data processor 6q may take these secondary noises into account and modify the frequency ratio.

The audio signal generator 6u comprises a digital filter, a digital-to-analog converter and a low-pass filter, and produces an analog audio signal from the pcm data codes supplied from the data memories 6m and 6o and/or the data processors 6n, 6p and 6q. The pcm data codes are subjected to a digital filtering, and are, then, converted into the analog audio signal. In the digital filtering, the vibration characteristics of the speaker system 6e and vibration characteristics of the speaker box 6f are taken into account, and the pcm data codes are modified in such a manner that the frequency spectrum of produced sounds becomes flat. The digital filter is of the FIR type in this instance. However, an IIR type digital filter is available. An oversampling type digital filter may follow the digital filtering for eliminating quantized noises.

After the digital filtering, the digital-to-analog converter produces the analog audio signal, and the analog audio signal is filtered by the low-pass filter, and the low-pass filter is of a Butterworth type for improving group delay. The analog audio signal thus filtered is supplied through the equalizer 6v to the amplifier unit 6d, and the amplifier unit 6d amplifies the analog audio signal for driving the speaker system 6e or the headphone 6h.

The floppy disk driver 6t reads out data codes formatted in accordance with the MIDI standards from a floppy disk under the control of the floppy disk controller 6s, and the supervisor 6k allows the audio signal generator 6u to reproduce sounds from the data codes read out from the floppy disk. Therefore, a music can-be reproduced in the timbre of another musical instrument such as, for example, a pipeorgan, a harpsichord or a wind musical instrument.

The supervisor 6k may format the detecting signals of the key sensors 6b and the detecting signal of the pedal sensor 6c in accordance with the MIDI standards, and the MIDI codes are stored in a floppy disk under the control of the floppy disk controller 6s. If the keyboard instrument can record a performance, the keyboard instrument has three modes of operation, i.e., the acoustic sound and silent modes and the recording mode.

As described hereinbefore, the supervisor 6k forms a part of the controlling system 5, and the mode flag indicative of the operation mode is incorporated in the supervisor 6k. The supervisor 6k instructs the motor driver 5b to rotate the motor in either direction depending upon the operation mode, and the rotary stopper 5c enters one of the free position FP and the blocking position BP.

As will be appreciated from the foregoing description, the rotary stopper 5c with the recesses 5p softly receives the hammer shanks 4k, and is prolonged the service time of the keyboard instrument without replacement of the cushion members.

In the above described embodiment, the recesses 5p are formed in the relatively soft cushion members 5m to 5o before the assembly into the acoustic piano 4. In order to form the recesses 5p, the soft cushion members 5m to 5o of felt may be treated with chemical solutions for a permanent wave commercially used for a woman's hair. The felt is usually formed from wool, and the first chemical solution cuts the cross linking so that the wool is liable to be shaped. A waved die is pressed against the felt for forming recesses, and the second chemical solution recovers the cross linking. Then, the recesses are permanently formed in the felt. One of the commercially available chemical solutions for a permanent is known as "Venezel Home Perma".

A soft cushion member of felt or rubber may be shaped under application of heat. Moreover, a milling is available for forming the recesses, and repeated impact accelerates the milling.

The recesses may be formed in the relatively soft cushion members 5m to 5o after the assembly of the keyboard instrument by using the hammer shanks 4k. Even after assembled, the repeated impacts of the hammer shanks 4k with or without water form the recesses 5p. The inner surfaces of the recesses 5p may not be equal in radius of curvature to the outer surfaces of the hammer shanks 4j, but are larger than the outer surfaces of the hammer shanks 4j, because the hammer shank 4j needs to rebound on a wider area of the cushion member than the prior art.

If the hammer shanks are, by way of example, trapezoid in cross section, the recesses are also trapezoid so as to be conformal with the outer surfaces of the hammer shanks. The cross section of the hammer shank and the recess may be a circle, an octagone or an ellipse.

Figure 7:
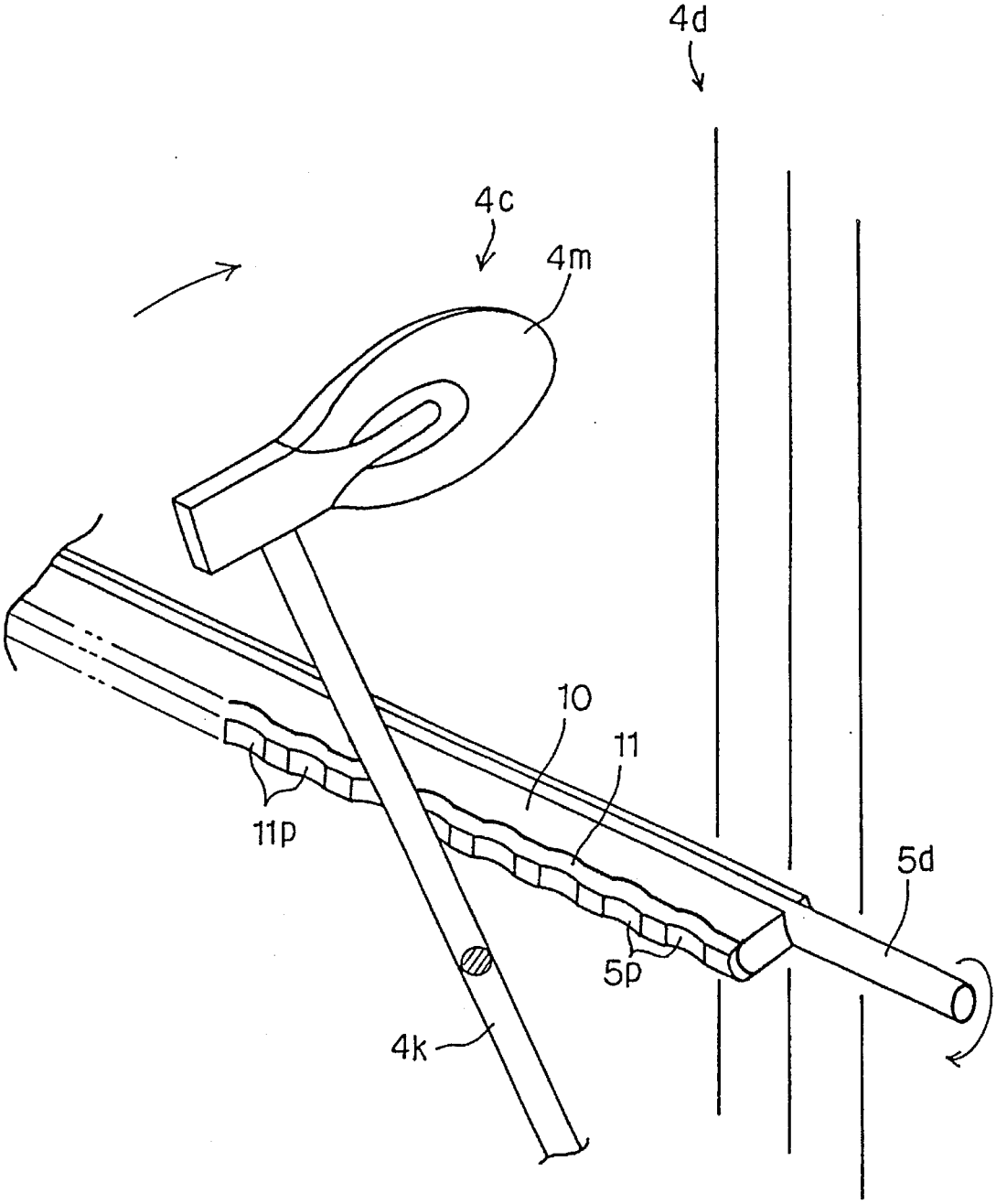
FIG. 7 is a perspective view showing another modification of the rotary stopper.
Figure 8:
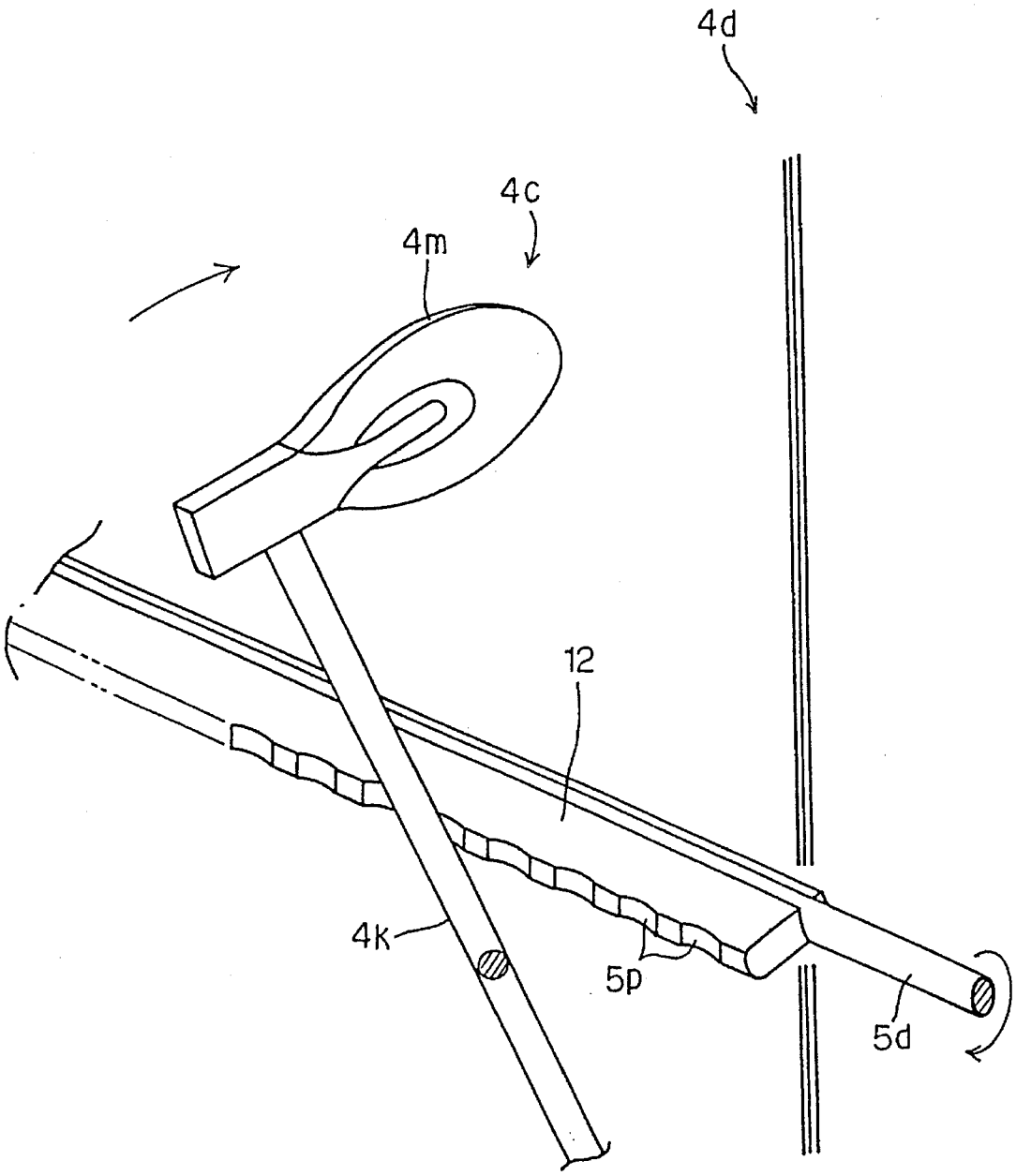
FIG. 8 is a perspective view showing yet another modification of the rotary stopper.

Moreover, a lamination of a relatively hard cushion member 10 and a relatively soft cushion member 11 may be directly bonded to the shaft member 5d as shown in FIG. 7, and the relatively soft cushion member 11 per se waves for forming the recesses 11p. If the impact of the hammer shank 4j is not so large, a single-level cushion member 12 may be directly attached to the shaft member 5d, and recesses are formed in the top surface of the single-level cushion member 12 as shown in FIG. 8.

Second Embodiment

Figure 9:
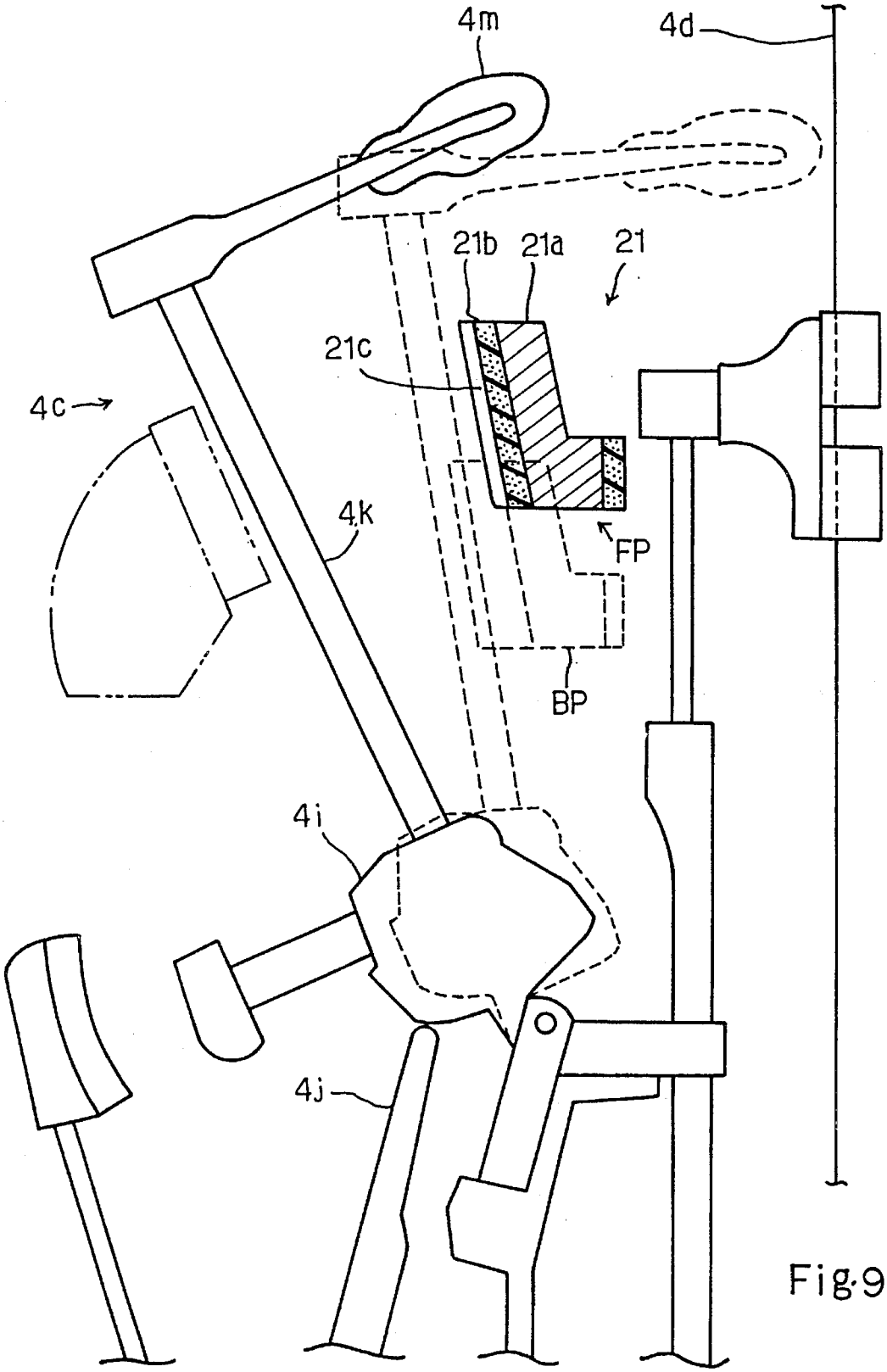
FIG. 9 is a side view showing essential parts of another keyboard instrument according to the present invention.
Figure 10:
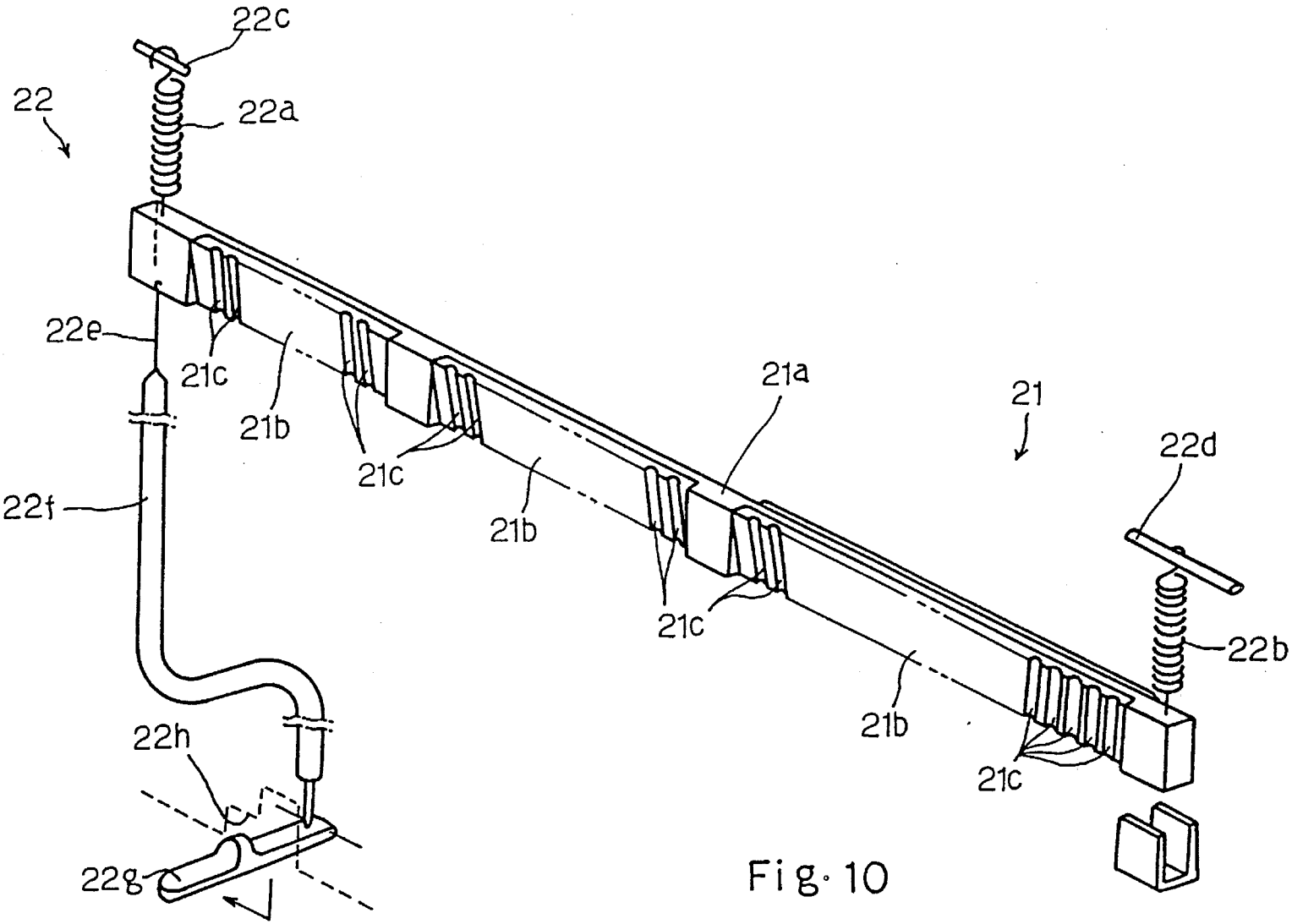
FIG. 10 is a perspective view showing a stopper incorporated in the keyboard instrument shown in FIG. 9.

Turning to FIG. 9 of the drawings, a stopper 21 is incorporated in another keyboard instrument embodying the present invention. The keyboard instrument implementing the second embodiment is similar in structure than the keyboard instrument shown in FIG. 3 except for the stopper 21 and an associated shifting mechanism 22 shown in FIG. 10, and the other components are labeled with references designating corresponding parts and units of the first embodiment without detailed description.

The stopper 21 comprises a elongated plate member 21a and cushion members 21b attached to the front surface of the plate member 21a at intervals. A plurality of recesses 21c are formed in the cushion members 21b, and are arranged in such a manner that the hammer shanks 4k rebound on the inner surfaces of the associated recesses 21c. The inner surfaces of the recesses 21c are substantially conformal to the contact portions of the hammer shanks 4k.

The plate member 21a is suspended through the coil springs 22a and 22b by pin members 22c and 22d fixed to side boards (not shown) of the acoustic piano 4, and is pulled down by means of the shifting mechanism 22. The shifting mechanism 22 comprises a wire 22e coupled with the plate member 21a, a pipe member 22f connected with the wire 22e, a pedal 22g coupled with the pipe member 22f, a step portion 22h formed in a bottom sill of the acoustic piano 4 and a limiter 22i.

If a player steps on the pedal 22g and leftwardly pushes the pedal 22g, the pedal 22g is engaged with the step portion 22h, and the shifting mechanism 22 keeps the plate member 21a in the blocking position BP. The plate member 21a thus kept in the blocking position BP inserts the right portion thereof into the limiter 22i, and the step portion 22h and the limiter 22i exactly define the blocking position BP.

As will be better seen from FIG. 9, while the stopper 21 is staying in the blocking position BP, the hammer shanks 4k rebound on the cushion members 21b before impacts on the strings 4d, and the strings 4d never vibrate for producing acoustic sounds. Therefore, the electronic sound producing system 6 synthesizes sounds with notes assigned to depressed keys 4g.

However, if the pedal 22g is released from the step portion 22h, the coil strings 22a and 22b pull up the plate member 21a, and the stopper 21 enters the free position FP. In the free position FP, the hammer heads 4m strike the strings 4d before the hammer shanks 4k reach the cushion members 22b. For this reason, the strings 4d vibrate at respective pitches, and produce the acoustic sounds.

In this instance, the pedal 22g is changed between two positions. However, one more step may be formed therebetween, and the intermediate step keeps the stopper 21 at an intermediate for decreasing loudness of the acoustic sounds.

The recesses 21c are usually formed in the cushion members 21b before delivery from a piano factory. However, the recesses 21c may be formed in the cushion members 21b after the delivery by pressing the hammer shanks 4k against the cushion members 21b.

The keyboard instrument implementing the second embodiment achieves all of the advantages of the present invention.

Third Embodiment

Figure 11:
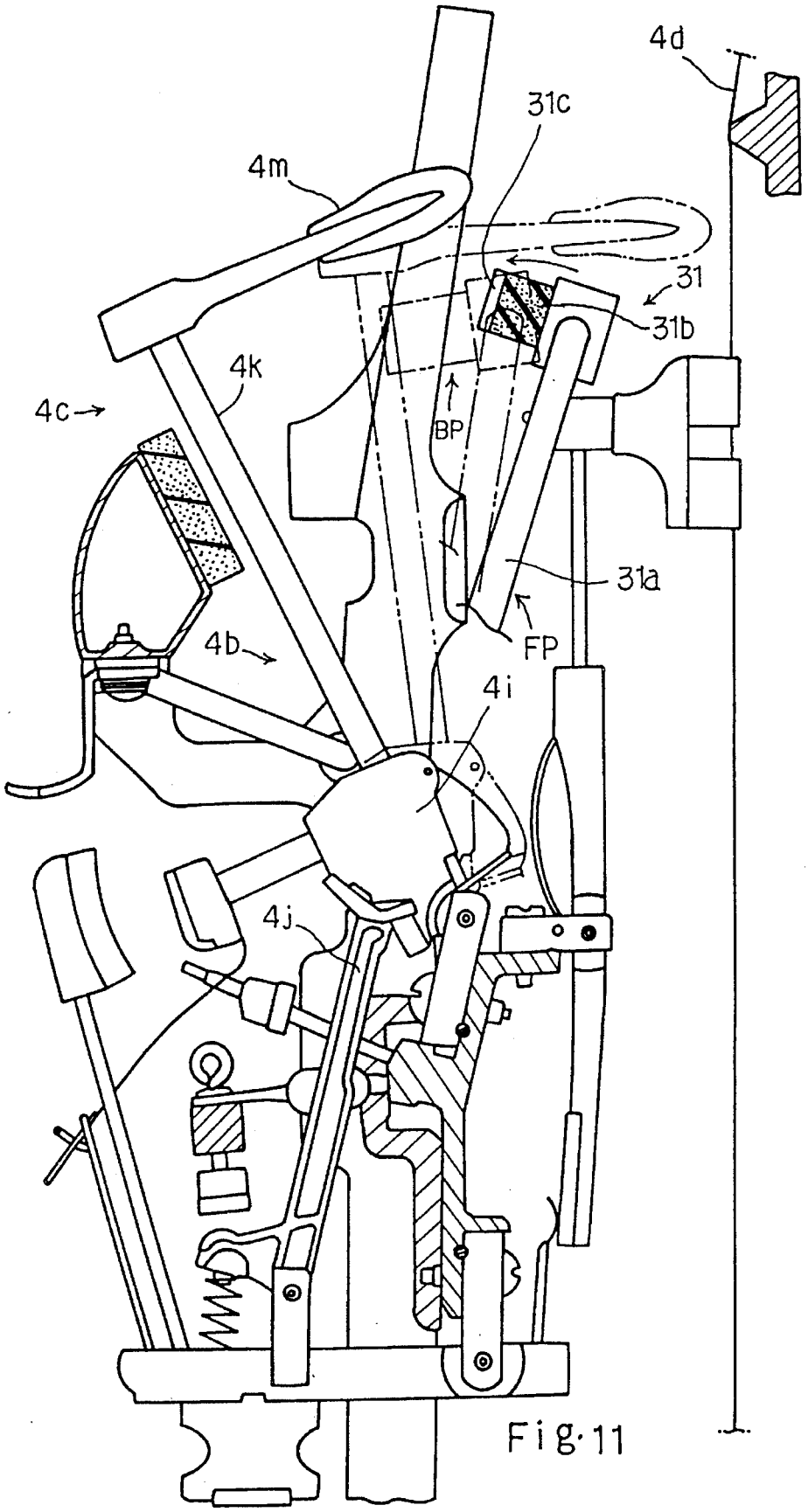
FIG. 11 is a side view showing essential parts of yet another keyboard instrument according to the present invention.

Turning to FIG. 11 of the drawings, yet another keyboard instrument embodying the present invention is equipped with a swingable stopper 31. The other components of the keyboard instrument implementing the third embodiment are similar to those of the first embodiment, and are labeled with the references designating the corresponding parts and units without detailed description.

The swingable stopper 31 comprises a frame structure 31a swingable around a center axis (not shown) and a cushion member 31b attached to an upper portion of the front surface of the frame structure 31a. A plurality of recesses 31c are formed in the front portion of the cushion member 31b as similar to the cushion members 21b, and the recesses 31c are substantially conformal to the opposite surfaces of the hammer shanks 4k. The cushion member 31b may be split into a plurality of cushion sub-members.

A suitable shifting mechanism is provided for the frame structure 31*a*, and the swingable stopper 31 is changed between the free position FP and the blocking position BP. In the free position FP, the hammer shanks 4*k* do not reach the cushion member 31*b*, and the hammer heads 4*m* strike the associated strings 4*d* without interruption of the swingable stopper 31. The strings 4*d* vibrates, and produces acoustic sounds.

On the other hand, if the swingable stopper 31 is changed to the blocking position BP through a swinging motion of the frame structure 31*a*, the hammer shanks 4*k* rebound on the inner surfaces of the recesses 31*c* before the impact, and the electronic sound producing system 6 causes one of the speaker system 6*e* or the headphone 6*h* to produce synthesized sounds with the notes assigned to the depressed keys 4*g*.

The recesses 31*c* are usually formed before the assembly of the keyboard instrument in a piano factory. However, the recesses may be formed after the delivery from the piano factory by pressing the hammer shanks against the cushion member 31*b*.

The keyboard instrument implementing the third embodiment achieves all of the advantages of the present invention.

Fourth Embodiment

Figure 12:
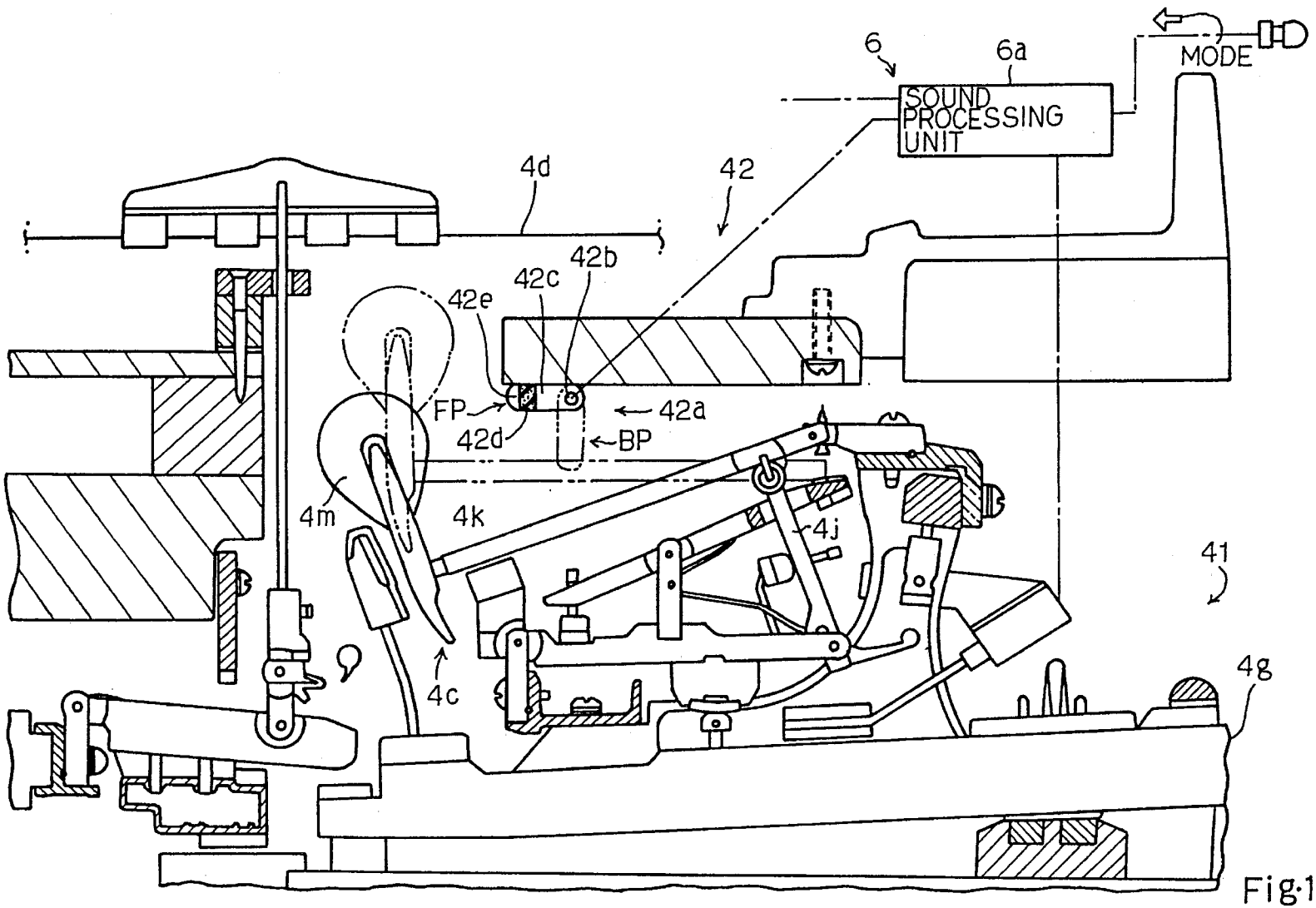
FIG. 12 is a side view showing essential parts of a keyboard instrument according to the present invention.

Turning to FIG. 12 of the drawings, still another keyboard instrument embodying the present invention largely comprises a grand piano 41, the electronic sound producing system 6 and a controlling system 42. The grand piano 41 has parts and members corresponding to the upright piano 4, and the parts and the members of the grand piano 41 are labeled with the references corresponding parts and corresponding members of the acoustic piano 4 without detailed description for the sake of simplicity.

The controlling system 42 comprises a swingable stopper 42*a* provided over the hammer shanks 4*k*, and the sound processing unit 6*a* is shared between the electronic sound producing system 6 and the controlling system 42 as similar to the first embodiment. The swingable stopper 42*a* comprises a shaft member 42*b*, a frame structure 42*c* swingable around the shaft member 42*b* and a cushion member 42*d*, and a plurality of recesses 42*e* formed in the cushion member 42*d*. The inner surfaces of the recesses 42*e* are conformal to the contact portion of the hammer shanks 4*k*, and the cushion member 42*d* may be split into a plurality of cushion sub-members.

When the swingable stopper 42*a* is changed to the free position FP, the hammer shanks 4*k* do not reach the cushion member 42*d*, and the hammer heads 4*m* strike the associated strings 4*d* without interruption of the swingable stopper 42*a*. The strings 4*d* vibrates, and produces acoustic sounds.

On the other hand, if the swingable stopper 42*b* is changed to the blocking position BP through a swinging motion of the frame structure 42*c*, the hammer shanks 4*k* rebound on the inner surfaces of the recesses 42*e* before the impact, and the electronic sound producing system 6 causes one of the speaker system 6*e* or the headphone 6*h* to produce synthesized sounds with the notes assigned to the depressed keys 4*g*.

The recesses 42*e* are usually formed before the assembly of the keyboard instrument in a piano factory. However, the recesses 42*e* may be formed after the delivery from the piano factory by pressing the hammer shanks against the cushion member 42*d*.

The keyboard instrument implementing the fourth embodiment achieves all of the advantages of the present invention.

Fifth Embodiment

Figure 13:
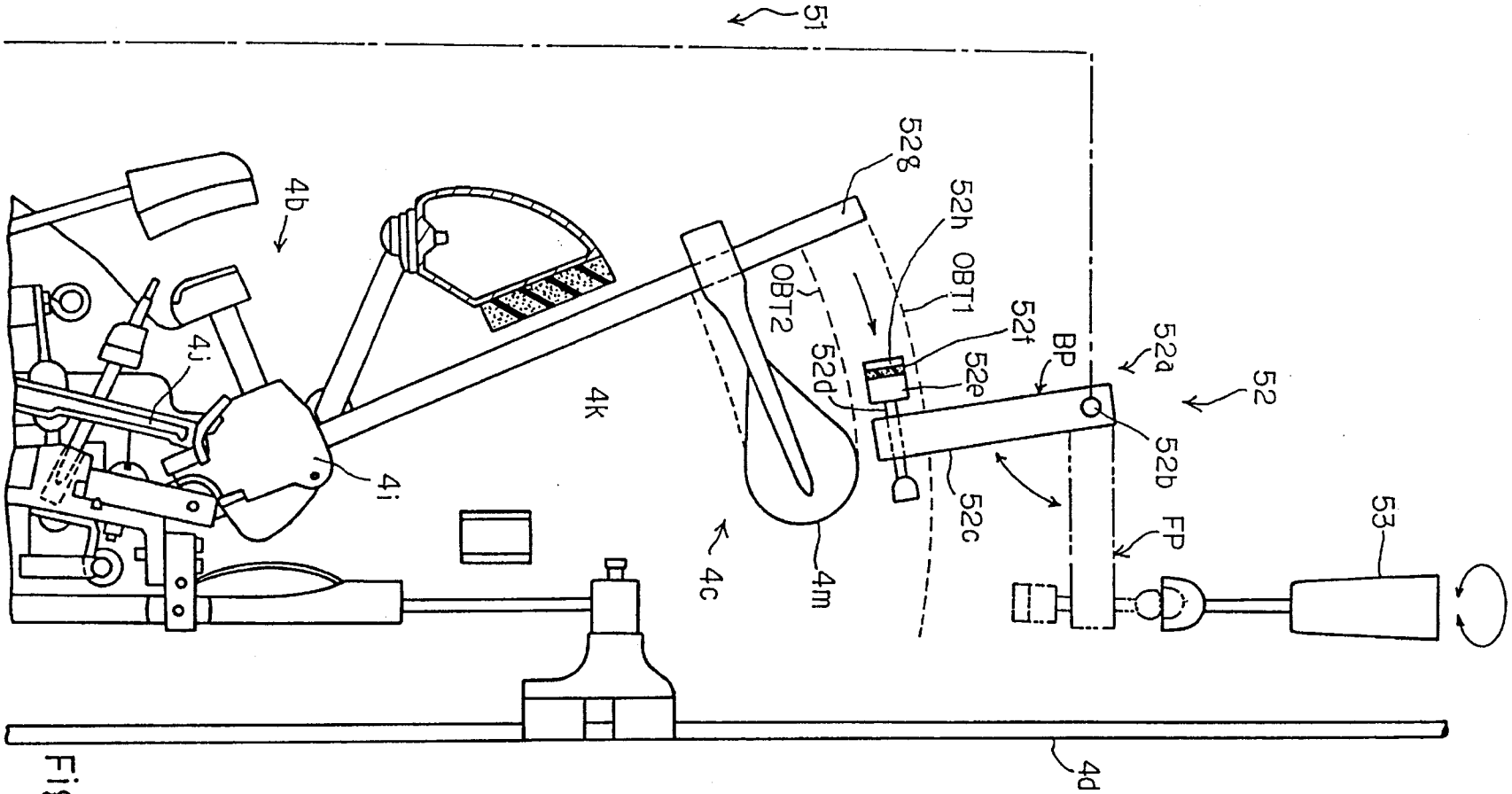
FIG. 13 is a side view showing essential parts of a keyboard instrument according to the present invention.

Turning to FIG. 13 of the drawings, a keyboard instrument embodying the present invention also comprises an upright piano 51, an electronic sound producing system (not shown) and a controlling system 52. The upright piano 51 and the electronic sound producing system are similar to those of the keyboard instrument shown in FIG. 3, and parts and members of the upright piano 51 are labeled with the references designating the corresponding parts and members without detailed description.

The controlling system 52 has a swingable stopper 52*a* and an associated shifting mechanism for shifting the swingable stopper 52*a* between the free position FP and the blocking position BP.

The swingable stopper 52*a* comprises a rotatable shaft member 52*b* coupled with the shifting mechanism, a frame structure 52*c* swingably supported by the rotatable shaft member 52*b*, screw members screwed through the leading end portion of the frame structure 52*c*, a bracket member 52*d* attached to the screw members 52*d*, a cushion member 52*f* attached to the bracket member 52*d* and extensions 52*g* respectively projecting from the hammer heads 4*m*. The screw members 52*d* are turnable with a jig member 53, and the position of the cushion member 52*f* is regulable.

A plurality of recesses 52*h* are formed in the cushion member 52*f*, and the cushion member 52*h* may be split into a plurality of cushion sub-members. The receses are usually formed before the assembly in a piano factory. However, the recesses 52*h* may be formed by pressing the extensions 52*g* against the cushion member 52*f* after delivery from the piano factory.

If the shifting mechanism keeps the swingable stopper 52*a* in the free position FP, the cushion member 52*f* is out of the orbits OBT1 of the extensions 52*g*, and the hammer heads 4*m* can strike the strings 4*d* without an interruption of the swingable stopper 52*a*. As a result, the strings 4*d* vibrate, and produce an acoustic sound.

On the other hand, if the shifting mechanism changes the swingable stopper 52*a* to the blocking position BP, the cushion member 52*f* are located inside of the orbits OBT1 and out of the orbits OBT2 of the hammer heads 4*m*. When a player depresses a key, the associated key action mechanism 4*b* drives the hammer assembly 4*c* for rotation, and the extension 52*g* rebounds on the inner surface of the recess 52*h* before the impact. The strings 4*d* do not vibrate, and the electronic sound producing system synthesizes a sound with the note assigned to the depressed key.

The keyboard instrument implementing the fifth embodiment achieves all of the advantages of the present invention.

Although particular embodiments of the present invention have been shown and described, it will be obvious to those skilled in the art that various changes and modifications may be made without departing from the spirit and scope of the present invention.

What is claimed is:

1. A keyboard instrument selectively entering into an acoustic sound mode for producing acoustic sounds and a silent mode for producing synthesized sounds, comprising:

a) an acoustic piano having a-1) a keyboard having a plurality of swingable keys selectively depressed by a player in both acoustic sound and silent modes, a-2) a plurality of key action mechanisms respectively linked with said plurality of swingable keys, and actuated by the depressed keys in both acoustic sound and silent modes, a-3) a plurality of hammer assemblies having respective contact portions, and selectively driven by the key action mechanisms linked with said depressed keys for rotations in both acoustic sound and silent modes, and a-4) a plurality sets of strings respectively associated with said plurality of hammer assemblies, and selectively struck by the hammer assemblies associated with said key action mechanisms linked with said depressed keys in said acoustic sound mode for producing said acoustic sounds;

b) a controlling system having a stopper, and responsive to an instruction of said player for changing said stopper between a free position in said acoustic sound mode and a blocking position in said silent mode, said hammer assemblies rebounding on the associated sets of strings when said stopper is in said free position, said hammer assemblies rebounding on said stopper before the impacts of said hammer assemblies on said associated sets of strings when said stopper is changed to said blocking position, said stopper having a plurality of recesses for receiving the contact portions of said hammer assemblies, an inner surface of each of said receses being substantially conformal to a part of the outer surface of said contact portion of the associated hammer assembly; and c) an electronic sound generating system enabled in said silent mode, and producing the synthesized sounds with notes assigned to said depressed keys.

2. The keyboard instrument as set forth in claim 1, in which said recesses are formed in said stopper by pressing said contact portions against said stopper.

3. The keyboard instrument as set forth in claim 1, in which said stopper comprises a rotatable shaft member rotatably provided in a space between said plurality of hammer assemblies at home positions thereof and said plurality sets of strings, a relatively hard cushion member means supported by said rotatable shaft member, and a relatively soft cushion member means laminated on said relatively hard cushion member means and having said recesses.

4. The keyboard instrument as set forth in claim 1, in which said stopper comprises a plate member provided in a space between said plurality of hammer assemblies at home positions thereof and said plurality of strings, and having a surface opposing to said plurality of hammer assemblies at home positions thereof, a cushion member means attached to said surface and having said recesses allowing said contact portions of said hammer assemblies to rebound on the inner surfaces of said recesses, and a shifting mechanism manipulated by said player for shifting between said free position and said blocking position.

5. The keyboard instrument as set forth in claim 1, in which said stopper comprises a frame structure swingable and provided in a space between said plurality of hammer assemblies at home positions thereof and said plurality sets of strings, a cushion member means attached to a surface of said frame structure in opposing relation to said plurality of hammer assemblies, and having said recesses allowing said contact portions of said hammer assemblies to rebound on the inner surfaces of said recesses, and a shifting means for shifting said cushion member means between said free position and said blocking position through a swing motion of said frame structure.

6. The keyboard instrument as set forth in claim 5, in which said recesses are formed by depressing said contact portions against said cushion member means.

7. The keyboard instrument as set forth in claim 1, in which said plurality of hammer assemblies have respective extensions attached to leading ends thereof, said extensions respectively serving as said contact portions, respectively, and in which said stopper comprises a frame structure swingable into and out of a space between said extensions of said plurality of hammer assemblies at home positions thereof and said plurality sets of strings, a cushion member means supported by said frame structure, and movable into said blocking position when said frame structure is swung into said space, and having said recesses allowing the extensions of said hammer assemblies to rebound on the inner surfaces of said recesses, said cushion member means being shifted to said free position when said frame structure is swung out of said space, and a shifting means for shifting said cushion member means between said free position and said blocking position through a swing motion of said frame structure.

8. The keyboard instrument as set forth in claim 1, in which said acoustic piano is an upright piano.

9. The keyboard instrument as set forth in claim 1, in which said acoustic piano is a grand piano.

* * * * *